US010854039B2

(12) United States Patent
Lamb et al.

(10) Patent No.: US 10,854,039 B2
(45) Date of Patent: Dec. 1, 2020

(54) METHOD AND SYSTEM FOR A GAMING SYSTEM USER INTERFACE

(71) Applicant: Video Gaming Technologies, Inc., Franklin, TN (US)

(72) Inventors: William Douglas Lamb, Eagleville, TN (US); Daniel William Rice, Thompson Station, TN (US); Victor Brent McClearen, Cookeville, TN (US); Charles Stanley Curbbun, Encinitas, CA (US); Arvin Grande Abadilla, Encinitas, CA (US); Matthew Kranz, Encinitas, CA (US); Julian Groeli, San Diego, CA (US); Blake Chuanlun Wang, San Diego, CA (US); Jin Chen, Carlsbad, CA (US); William John Leach, San Diego, CA (US)

(73) Assignee: Video Gaming Technologies, Inc., Franklin, TN (US)

( * ) Notice: Subject to any disclaimer, the term of this patent is extended or adjusted under 35 U.S.C. 154(b) by 923 days.

(21) Appl. No.: 14/498,638

(22) Filed: Sep. 26, 2014

(65) Prior Publication Data

US 2016/0093143 A1 Mar. 31, 2016

(51) Int. Cl.
*G07F 17/32* (2006.01)
*G07F 17/34* (2006.01)

(52) U.S. Cl.
CPC ..... *G07F 17/3213* (2013.01); *G07F 17/323* (2013.01); *G07F 17/3209* (2013.01);
(Continued)

(58) Field of Classification Search
CPC ..... G07F 17/3213; G07F 17/3209; G07F 17/3239; G07F 17/323; G07F 17/3211;
(Continued)

(56) References Cited

U.S. PATENT DOCUMENTS

D399,670 S 10/1998 Miller et al.
6,008,784 A 12/1999 Acres et al.
(Continued)

FOREIGN PATENT DOCUMENTS

WO 2014108141 A1 7/2014

*Primary Examiner* — Kang Hu
*Assistant Examiner* — Thomas H Henry
(74) *Attorney, Agent, or Firm* — Armstrong Teasdale LLP

(57) ABSTRACT

A gaming machine includes a base, a columnar pedestal extending vertically from the base, and a button deck adjustably coupled to the pedestal. The button deck includes an upper surface including a transparent touchscreen element, a lower surface opposite the upper surface, and a button deck body extending therebetween. At least one of the lower surface and the body include one or more transparent display elements, the one or more transparent display elements are configured to generate images of gaming machine control actuators viewable on the upper surface. The transparent touchscreen element is configured to receive touches and gestures indicating control inputs. The gaming machine also includes a player tracking card reader positioned within the button deck and accessible through a slot in a front edge of the button deck, the player tracking card reader communicatively coupled to a player tracking display area of the gaming machine.

19 Claims, 4 Drawing Sheets

(52) U.S. Cl.
CPC ..... *G07F 17/3211* (2013.01); *G07F 17/3216* (2013.01); *G07F 17/3227* (2013.01); *G07F 17/3239* (2013.01); *G07F 17/34* (2013.01)

(58) Field of Classification Search
CPC ... G07F 17/3216; G07F 17/3227; G07F 17/34
See application file for complete search history.

(56) References Cited

U.S. PATENT DOCUMENTS

| | | | | |
|---|---|---|---|---|
| 6,102,394 | A | 8/2000 | Wurz et al. | |
| 6,102,476 | A | 8/2000 | May et al. | |
| 6,217,448 | B1 | 4/2001 | Olsen | |
| 6,514,145 | B1 | 2/2003 | Kawabata | |
| 6,530,842 | B1 | 3/2003 | Wells et al. | |
| 6,637,844 | B1 | 10/2003 | Luciano, Jr. et al. | |
| 6,646,695 | B1 | 11/2003 | Gauselmann | |
| 7,166,029 | B2 | 1/2007 | Enzminger | |
| 7,217,191 | B2 | 5/2007 | Cordell | |
| 7,562,872 | B2 | 7/2009 | Okada | |
| 7,699,315 | B2 | 4/2010 | Hirato et al. | |
| 7,896,746 | B2 | 3/2011 | Borissov | |
| 7,918,725 | B2 | 4/2011 | Baerlocher | |
| 7,955,176 | B2 | 6/2011 | Tastad et al. | |
| 8,012,027 | B2 | 9/2011 | McGahn et al. | |
| 8,047,916 | B2 | 11/2011 | Seelig et al. | |
| 8,096,884 | B2 | 1/2012 | Beadell et al. | |
| 8,113,517 | B2 | 2/2012 | Canterbury et al. | |
| 8,118,681 | B2 | 2/2012 | Mattice et al. | |
| 8,137,185 | B2 | 3/2012 | Crowder, Jr. et al. | |
| 8,177,637 | B2 | 5/2012 | Beadell et al. | |
| 8,216,046 | B2 | 7/2012 | Ikeya et al. | |
| 8,216,074 | B2 | 7/2012 | Sakuma | |
| 8,262,480 | B2 | 9/2012 | Cohen et al. | |
| 8,430,756 | B2 | 4/2013 | McComb et al. | |
| 8,439,761 | B2 | 5/2013 | O'Keene et al. | |
| 8,715,079 | B1 | 5/2014 | Loose | |
| 8,740,706 | B2 | 6/2014 | Klein | |
| 2004/0149866 | A1 | 8/2004 | Boucher et al. | |
| 2005/0113163 | A1* | 5/2005 | Mattice | G06F 3/03547 463/16 |
| 2006/0014586 | A1* | 1/2006 | Gatto | A47C 15/004 463/46 |
| 2006/0073868 | A1 | 4/2006 | Nordman | |
| 2006/0183544 | A1 | 8/2006 | Okada | |
| 2007/0035164 | A1 | 2/2007 | North | |
| 2007/0045960 | A1 | 3/2007 | Knoll | |
| 2007/0197301 | A1 | 8/2007 | Cole | |
| 2008/0182642 | A1 | 7/2008 | Cole | |
| 2008/0194326 | A1* | 8/2008 | Brunet De Courssou | G07F 17/3262 463/31 |
| 2009/0102419 | A1* | 4/2009 | Gwon | H01F 27/2871 320/108 |
| 2009/0176568 | A1* | 7/2009 | Reddy | G07F 17/3211 463/31 |
| 2009/0187125 | A1 | 7/2009 | Tran et al. | |
| 2009/0233681 | A1 | 9/2009 | Tsukahara | |
| 2009/0264194 | A1 | 10/2009 | Kompella | |
| 2009/0264195 | A1 | 10/2009 | Kompella | |
| 2009/0276320 | A1* | 11/2009 | Butler | G06Q 20/105 705/17 |
| 2009/0280911 | A1 | 11/2009 | Tsao | |
| 2010/0075755 | A1 | 3/2010 | Steelman | |
| 2010/0087249 | A1* | 4/2010 | Rowe | G07F 17/3216 463/31 |
| 2010/0120530 | A1 | 5/2010 | Lesley | |
| 2010/0144420 | A1 | 6/2010 | Fiore | |
| 2011/0118034 | A1 | 5/2011 | Jaffe et al. | |
| 2012/0004030 | A1 | 1/2012 | Kelly et al. | |
| 2012/0051520 | A1* | 3/2012 | Hoernig | A61B 6/107 378/98.5 |
| 2012/0122569 | A1 | 5/2012 | Kowolik | |
| 2013/0137524 | A1 | 5/2013 | Scott | |
| 2014/0141886 | A1 | 5/2014 | Woels et al. | |
| 2015/0087403 | A1* | 3/2015 | Castro | G07F 17/3209 463/25 |

* cited by examiner

METHOD AND SYSTEM FOR A GAMING SYSTEM USER INTERFACE

BACKGROUND

This description relates to gaming machines, and, more particularly, to a method and system for enhancing player comfort and ergonomics in gaming machines.

Gaming machines have evolved to a substantially consistent form due to interchangeability and standardization considerations. For example, button layouts follow a standard linear arrangement in which players' must adjust their reach to accomplish different actions. Rather than assuming a more ergonomic configuration that is less fatiguing to players, buttons of gaming machines are arranged at consistent intervals in a straight line pattern. Additionally, gaming cabinets have a footprint at floor level that is either similar to and that exceeds the dimensions of the game itself. Often, gaming machines are placed on box stands to elevate them to a consistent height. However, the box stands also extend to a footprint that meets or exceeds the dimensions of the game. Players at such gaming machines are constantly at odds of being near enough to the machine to comfortably reach the game buttons, but far enough away from the gaming machine to have room to place their feet in front of them. Placement of the button panel or button deck is generally fixed on the front of the cabinet and is not adjustable to facilitate game play or player comfort.

Such discomforts and poor ergonomics affect player satisfaction with the gaming machine and the gaming experience and may affect revenues of the affected machines.

BRIEF DESCRIPTION

In an aspect, a gaming machine includes a base, a columnar pedestal extending vertically from the base, the pedestal having a cross-sectional area, a width, and a depth that are less than each of a corresponding cross-sectional area, width, and depth of the base, and a button deck adjustably coupled to the pedestal. The button deck includes an upper surface including a transparent touchscreen element, a lower surface opposite the upper surface, and a button deck body extending therebetween. At least one of the lower surface and the body including one or more transparent display elements, the one or more transparent display elements configured to generate one or more images of gaming machine control actuators viewable on the upper surface, the transparent touchscreen element configured to receive from a user at least one of touches and gestures indicating control inputs to the gaming machine, the at least one of touches and gestures corresponding to the generated images. The gaming machine also includes a player tracking card reader positioned within the button deck and accessible through a slot in a front edge of the button deck, the player tracking card reader communicatively coupled to a player tracking display area of the gaming machine.

In another aspect, a gaming machine includes a pedestal configured to support one of a plurality of interchangeable game cabinets through a pedestal mating flange configured to engage a complementary game cabinet flange, one or more mating plugs configured to engage a complementary one or more mating plugs positioned proximate the mating flanges, the mating plugs configured to join respective signal and power conduits between the pedestal and the game cabinet. The gaming machine also includes a button deck adjustably coupled to the pedestal. The button deck includes an upper surface including a transparent touchscreen element, a lower surface opposite the upper surface, and a button deck body extending therebetween. At least one of the lower surface and the body including one or more transparent display elements, the one or more transparent display elements configured to generate one or more images of gaming machine control actuators viewable on the upper surface, the transparent touchscreen element configured to receive from a user at least one of touches and gestures indicating control inputs to the gaming machine, the at least one of touches and gestures corresponding to the generated images.

In a further aspect, a gaming machine pedestal includes a button deck adjustably coupled to the pedestal, the button deck including one or more extendable arms, each arm coupled at one end to the pedestal and at a second end to the button deck, the button deck extendable away from and towards the pedestal, and a player tracking card reader positioned within the button deck and accessible through a slot in a front edge of the button deck.

BRIEF DESCRIPTION OF THE DRAWINGS

FIG. 1 is a perspective view of a gaming machine in accordance with an example embodiment of the present disclosure.

FIG. 2 is a perspective view of a lower portion of the game cabinet in accordance with an example embodiment of the present disclosure.

FIG. 3 is an enlarged perspective view of the button deck shown in FIG. 1.

FIG. 4 is an illustration of embodiments of connections of the button deck to the column.

Although specific features of various embodiments may be shown in some drawings and not in others, this is for convenience only. Any feature of any drawing may be referenced and/or claimed in combination with any feature of any other drawing.

Unless otherwise indicated, the drawings provided herein are meant to illustrate features of embodiments of the disclosure. These features are believed to be applicable in a wide variety of systems comprising one or more embodiments of the disclosure. As such, the drawings are not meant to include all conventional features known by those of ordinary skill in the art to be required for the practice of the embodiments disclosed herein.

DETAILED DESCRIPTION

The following detailed description illustrates embodiments of the disclosure by way of example and not by way of limitation. It is contemplated that the disclosure has general application to gaming machine embodiments providing player comfort and ergonomic considerations in industrial, commercial, and residential applications.

The following description refers to the accompanying drawings, in which, in the absence of a contrary representation, the same numbers in different drawings represent similar elements.

Figure 1:
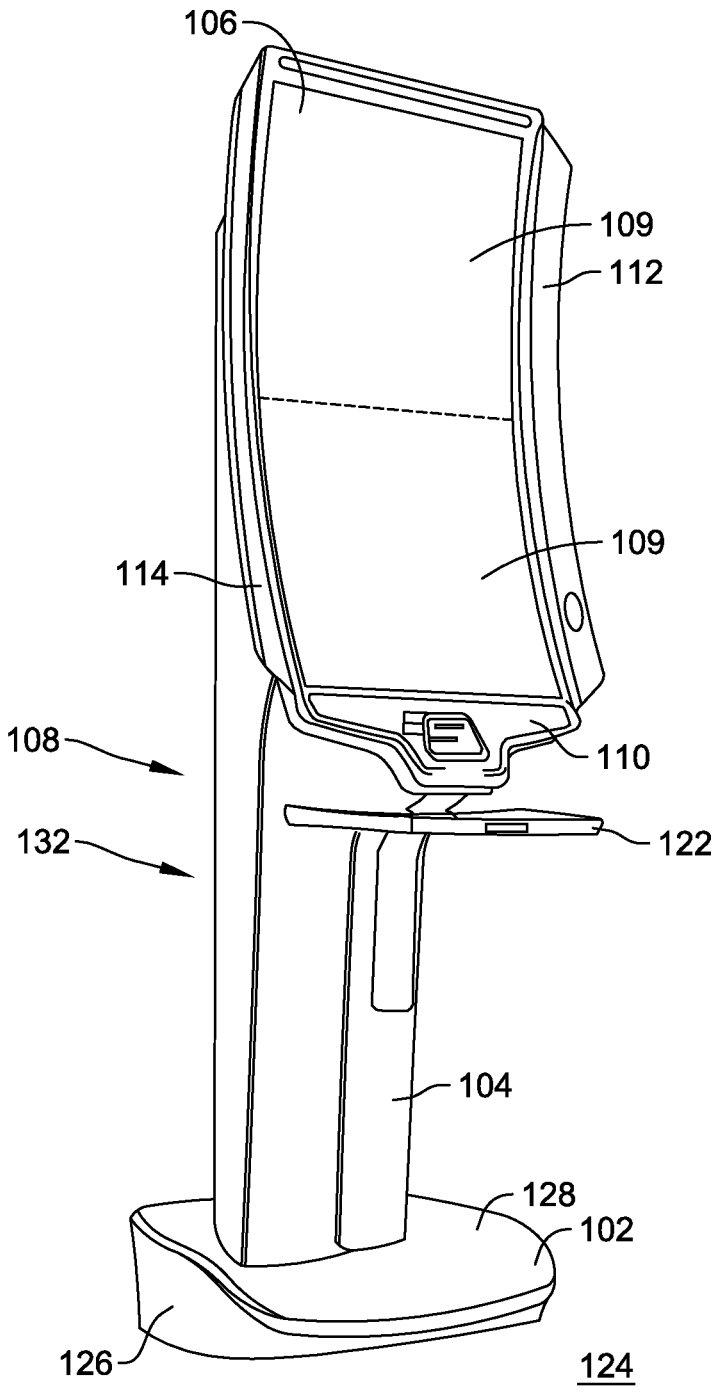
FIGS. 1-4 show example embodiments of the method and apparatus described herein.

FIG. 1 is a perspective view of a gaming machine 100 in accordance with an example embodiment of the present disclosure. In the example embodiment, gaming machine 100 includes a base 102 and a column 104 supported by base 102. A game cabinet 106 is coupled to an upper portion 108 of column 104. Game cabinet 106 includes one or more video display panels 109, a plurality of auxiliary devices, such as, but, not limited to a first user interface 110, a first side panel 112, and a second side panel 114. Gaming machine 100 also includes a button deck 122 adjustably coupled to column 104, game cabinet 106, and/or first user interface 110.

In the example embodiment, base 102 is configured to rest on or be coupled to a lower horizontal surface such as, but, not limited to, a floor 124. Base 102 includes one or more vertically upwardly extending sidewalls 126, which may include straight panels, and/or curved and contoured panels, such as, but, not limited to a circular, oval, oblong, and/or irregularly curved cross-section. Base 102 includes an upper surface 128 configured to fair base 102 by producing a closed smooth outline, support column 104, and/or provide a resting place for a user's feet.

Column 104 is a rigid, relatively slender, upright support, composed of relatively few components that extends vertically between base 102 and game cabinet 106. In various embodiments, column 104 includes a cylindrical or polygonal shaft 132. Column 104 houses various components and conduits that are configured to support the operation of gaming machine 100 and its integration into a larger operation and control network (not shown), in which gaming machine 100 is in communication.

Figure 2:
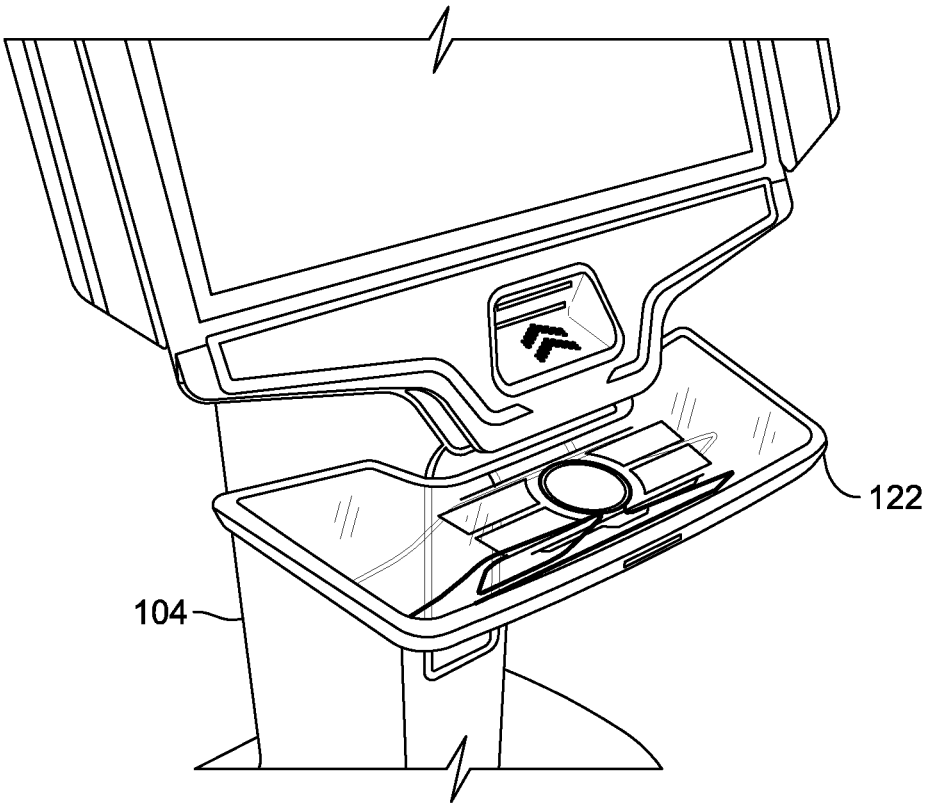

In various embodiments, button deck 122 is mounted to column 104 and is controlled through a gaming machine 100 controller (not shown in FIGS. 1 and 2). In one embodiment, button deck 122 is configured to translate with respect to column 104 in a single direction, for example, towards and away from column 104. In some embodiments, the translation is controlled manually by the user, automatically by a motor, or combinations thereof. For example, when gaming machine 100 detects a user entering a proximity of gaming machine 100, button deck 122 may be commanded to translate in either direction to indicate to the user that button deck 122 is movable. The user may then adjust button deck 122 manually by hand, manually through operation of a switch controlling the button deck motor, or allow button deck 122 to be controlled automatically by gaming machine 100. The user may also turn off the automatic translation feature using an override switch (not shown). Button deck 122 may be configured to translate in a plurality of directions and/or rotate around a plurality of axes to suit the user's comfort and ergonomic control.

Figure 3:
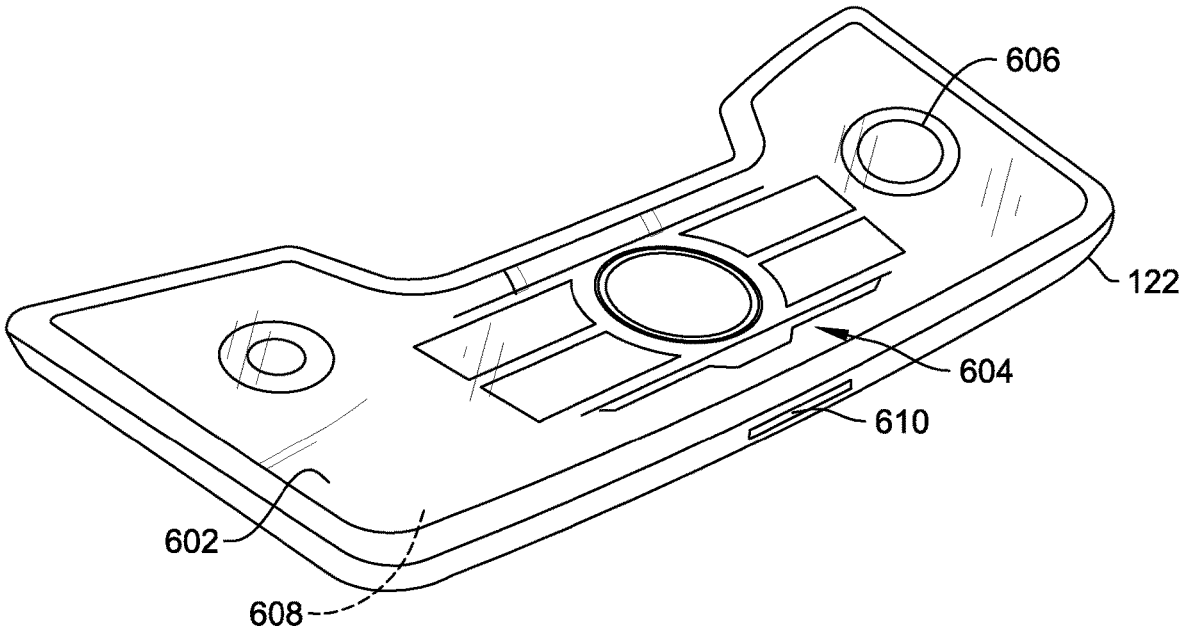

FIG. 2 is a perspective view of a lower portion of game cabinet 106 in accordance with an example embodiment of the present disclosure. FIG. 3 is an enlarged perspective view of button deck 122. In the example embodiment, button deck 122 includes an upper input surface 602 that may be embodied in a touchscreen surface or may be embodied in a combination of touchscreen elements 604 and mechanical input devices 606. For example, upper input surface 602 may include touchscreen elements for inputting various wager amounts, a "service" call button, a "cash-out" button, and other input requirements and also include a mechanical "spin" button 606. Touchscreen elements 604 may be isolated to certain areas of surface 602 and may be fixed in their function. However, in some embodiments, touchscreen elements 604 may be relocatable on surface 602 and may be reconfigurable to perform different functions during different portions of a game or for different games, such as when game cabinet 106 is interchanged. In one embodiment, button deck 122 is at least partially transparent or translucent, which permits a user to see through button deck 122, permits light from sources below button deck 122 to be seen by the user, and gives an appearance of mechanical "spin" button 606 and touchscreen elements 604 floating in front of the user.

Upper input surface 602 also may include an element 608 configured to control an opacity of button deck 122. Element 608 may comprise a liquid crystal display (LCD) element or other element configured to be electrically controlled to alter its transmissive properties. Element 608 may be configured to control opacity of button deck 122 as a whole or may be configured to control smaller regions of button deck 122 to present graphical objects to the user.

Button deck 122 also includes a card reader 610 for player tracking and communication. Card reader 610 is a part of a player tracking system that receives a player tracking card inserted and removed by the user. Card reader 610 transfers information stored on a player card to gaming machine 100. Gaming machine 100 is configured to provide player information on a player information portion (not shown in FIG. 6) of video display panel 109. In one embodiment, the player information portion is a reserved area that can be observed during game play. In other embodiments, the player information portion is overlaid onto a game screen during play or between games. When the player information portion is reserved, player information may only be displayed during predetermined times or when activated by the user. In other embodiments, the player information is dimmed or grayed out so as not to detract from the appearance of the game during game play.

Figure 4:
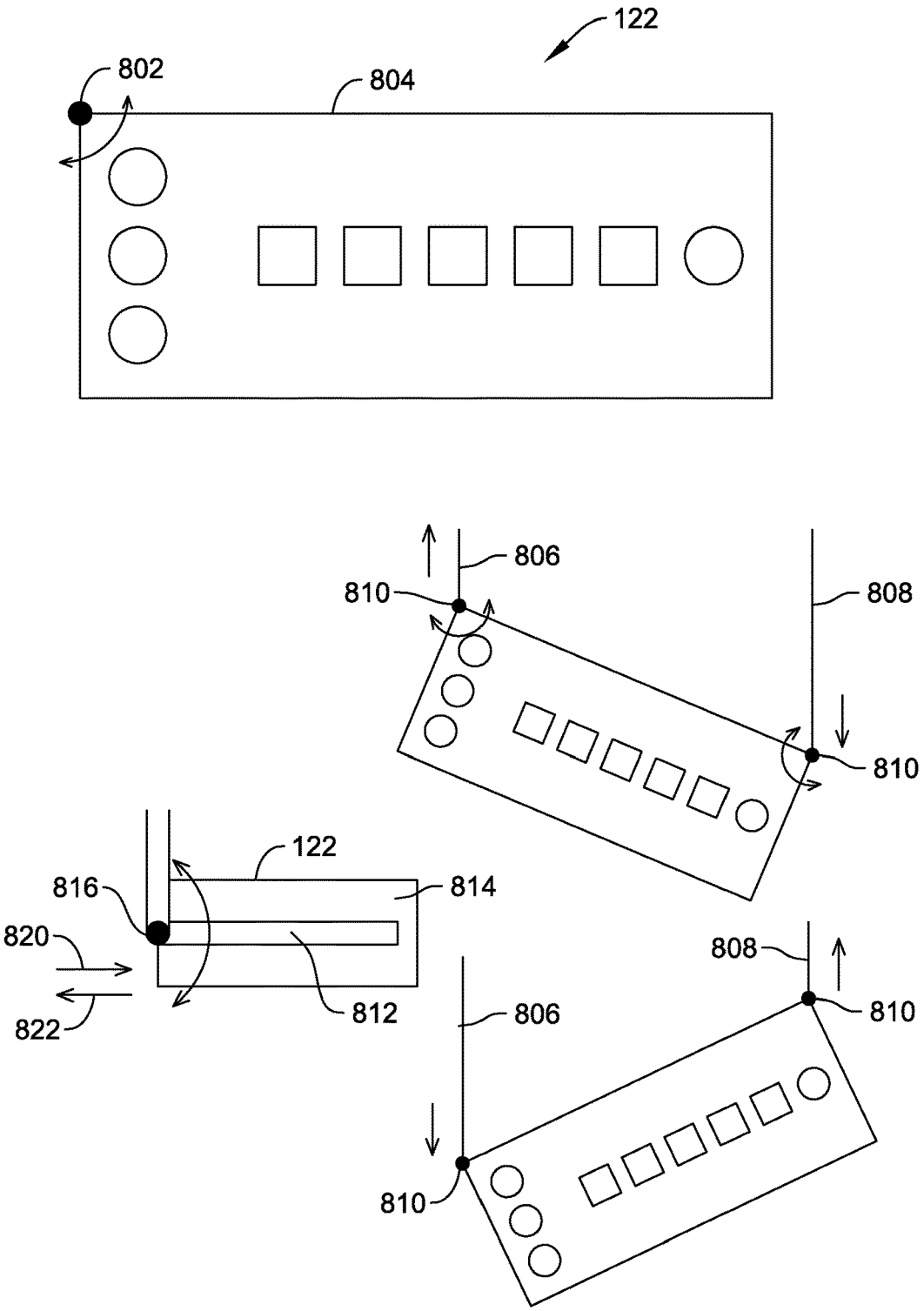

FIG. 4 is an illustration of embodiments of connections of button deck 122 to column 104. In a first alternative embodiment, button deck 122 is pivotally coupled to column 104 through a pivot point 802 located along a rear edge 804 of button deck 122. In the example embodiment, pivot point 802 is positioned in a corner of button deck 122, however pivot point 802 can be located at any position along rear edge 804. A second alternative embodiment includes a first support arm 806 and a second support arm 808. In the example embodiment, support arms 806 and 808 are telescoping in that one of first support arm 806 and second support arm 808 may be extended at different rates and/or distances to permit button deck 122 to be angled with respect to column 104. Such an orientation may be beneficial to, for example, a user that is not positioned directly in front of gaming machine 100. To support such movement, a connection point 810 between first support arm 806 and second support arm 808 and button deck 122 is pivotable about connection point 810. A third alternative embodiment is illustrated where a track 812 along an underside 814 of button deck 122 is configured to receive a pivotable knob 816 coupled to an arm 818 extending from column 104. During operation, button deck 122 can be translated laterally along track 812 in a first direction 820 or a second direction 824 and/or rotated about knob 816 at any point along track 812.

This written description uses examples to describe the disclosure, including the best mode, and also to enable any person skilled in the art to practice the disclosure, including making and using any devices or systems and performing any incorporated methods. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A gaming machine comprising:

a base;

a columnar pedestal extending vertically from said base, said pedestal having a cross-sectional area, a width, and a depth that are less than each of a corresponding cross-sectional area, width, and depth of said base; and a transparent button deck adjustably coupled to said pedestal by at least one telescoping support arm, said transparent button deck being configured to translate toward and away from said columnar pedestal through retraction and extension of the transparent button deck using the at least one telescoping, support arm, said transparent button deck permits a user to see through said transparent button deck and permits a user to translate the transparent button deck, said transparent button deck comprising:

an upper surface comprising a transparent touchscreen element;

a transparent lower surface opposite said upper surface; and a transparent button deck body extending therebetween, at least one of said transparent lower surface and said transparent button deck body comprising one or more transparent display elements, said one or more transparent display elements configured to generate one or more images of gaming machine control actuators viewable on said upper surface, said transparent touchscreen element configured to receive from a user at least one of touches and gestures indicating control inputs to said gaming machine, the at least one of touches and gestures corresponding to the generated images; and a player tracking card reader positioned within the button deck and accessible through a slot in a front edge of the button deck, said player tracking card reader communicatively coupled to a player tracking display area of said gaming machine.

2. The gaming machine of claim 1, further comprising opaque components positioned within said transparent button deck body, said one or more transparent display elements configured to disguise an appearance of said opaque components.

3. The gaming machine of claim 1, wherein said transparent button deck is configured to permit a user to reconfigure a layout of the generated one or more images of gaming machine control actuators using a drag and drop process.

4. The gaming machine of claim 1, wherein said transparent button deck is configured to display player tracking information viewable on said upper surface.

5. The gaming machine of claim 1, wherein said transparent button deck is configured to remain transparent to a user during predetermined periods of game play.

6. The gaming machine of claim 1, wherein said transparent button deck is configured to display at least one of game-related images and video viewable on said upper surface.

7. The gaming machine of claim 1, wherein said transparent button deck is configured to display at least one of ambient images and video viewable on said upper surface.

8. The gaming machine of claim 1, wherein said upper surface further comprises a wireless charger element configured to transfer energy to a battery-powered device positioned in proximity to said wireless charger element.

9. The gaming machine of claim 8, wherein said wireless charger element utilizes inductive coupling to transfer the energy.

10. The gaming machine of claim 8, wherein said wireless charger element utilizes resonant energy transfer based on oscillating magnetic fields to transfer the energy.

11. The gaming machine of claim 1, further comprising a game cabinet comprising:

at least one of a single video display panel, a plurality of video display, panels, and a combination of mechanical reels and one or more video display panels;

a mating flange configured to releasably mount to a complementary pedestal flange positioned at an upper edge of said pedestal; and one or more first mating plugs configured to engage a complementary one or more second mating plugs positioned proximate said mating flanges, said one or more first mating plugs and said one or more second mating plugs configured to join respective signal and power conduits between said pedestal and said game cabinet.

12. The gaming machine of claim 1, further comprising a user interface comprising:

a value acceptor slot positioned at a rear edge of a flat receiving surface, the flat receiving surface including a graphical output device configured to indicate an expected action to a user; and a printer slot oriented in a downward angle of about 0' to about 90' with respect to horizontal.

13. The gaming machine of claim 12, wherein the graphical output device configured to display at least one of a static graphic item and a dynamic graphic item related to a state of said gaming machine.

14. The gaming machine of claim 12, wherein the graphical output device comprises at least one of an array of addressable lights and a video display panel.

15. The gaming machine of claim 1, wherein the transparent button deck further comprises a transparency element configured to control an opacity, level of at least one region of the transparent button deck.

16. A gaming machine comprising:

a pedestal configured to support one of a plurality of interchangeable game cabinets through a pedestal mating flange configured to engage a complementary game cabinet flange, one or more first mating plugs configured to engage a complementary one or more second mating plugs positioned proximate said mating flanges, said one or more first mating plugs and said one or more second mating plugs configured to join respective signal and power conduits between said pedestal and said game cabinet; and a transparent button deck adjustably coupled to said pedestal by at least one telescoping support arm, said transparent button deck being configured to translate toward and away from said columnar pedestal through retraction and extension of the transparent button deck using the at least one telescoping support arm, said transparent button deck permits a user to see through the button deck and permits a user to translate the transparent button deck, said transparent button deck comprising:

an upper surface comprising a transparent touchscreen element, a transparent lower surface opposite said upper surface;

a transparent button deck body extending therebetween; and at least one of said transparent lower surface and said button deck body comprising one or more transparent display elements, said one or more transparent display elements configured to generate one or more images of gaming machine control actuators viewable on said upper surface, said transparent touchscreen element configured to receive from a user at least one of touches and gestures indicating control inputs to said gaming machine, the at least one of touches and gestures corresponding to the generated images.

17. The gaming machine of claim 16, wherein said display area comprises at least one of a single video display panel, a plurality of video display panels, and a combination of mechanical reels and one or more video display panels.

18. The gaming machine of claim 16, further comprising a pedestal configured to couple to game cabinet through a mechanical coupling flange, signal coupling connectors, and at least one power conduit connector.

19. The gaming machine of claim 18, further comprising a user interface comprising a unitary value acceptor and a printer bezel, said printer bezel comprising a flat receiving surface configured to direct at least one of currency and vouchers into a first value acceptor slot proximate an edge of said receiving surface, said printer bezel comprising a second downwardly oriented printer slot positioned above said first value acceptor slot and configured to direct items exiting said printer bezel towards said receiving surface.

* * * * *